US006871761B2

(12) United States Patent
Fox

(10) Patent No.: US 6,871,761 B2
(45) Date of Patent: Mar. 29, 2005

(54) POST-MIX BEVERAGE DISPENSER FOR FROTHED BEVERAGES

(76) Inventor: David Fox, 4174 Alonzo Ave., Encino, CA (US) 91316

( * ) Notice: Subject to any disclaimer, the term of this patent is extended or adjusted under 35 U.S.C. 154(b) by 28 days.

(21) Appl. No.: 10/454,453

(22) Filed: Jun. 3, 2003

(65) Prior Publication Data

US 2004/0245287 A1 Dec. 9, 2004

(51) Int. Cl.[7] ..... B67B 7/00

(52) U.S. Cl. ..... 222/129.1; 222/145.5; 99/323.2; 366/165.1; 366/165.4

(58) Field of Search ..... 222/129–129.4, 222/145.5–145.8, 145.1; 99/323.2; 366/165.1, 165.4

(56) References Cited

U.S. PATENT DOCUMENTS 4,676,401 A 6/1987 Fox et al.
4,808,346 A * 2/1989 Strenger ..... 261/18.1
4,922,810 A 5/1990 Siccardi
5,000,351 A 3/1991 Rudick
5,570,822 A 11/1996 LeMarbe et al.
5,938,327 A 8/1999 Benskin et al.
5,980,969 A 11/1999 Mordini et al.
6,305,269 B1 10/2001 Stratton

* cited by examiner

*Primary Examiner*—J. Casimer Jacyna
(74) *Attorney, Agent, or Firm*—Aaron T. Borrowman; Kelly Lowry & Kelley, LLP

(57) ABSTRACT

A post-mix beverage dispenser includes a diluent jet directed at a wall of a mixing chamber thereof such that a swirling descending mass of diluent is formed. A concentrate dispensing outlet ejects concentrate into the swirling mass of diluent causing turbulent mixing of the diluent and the concentrate to create a frothed or whipped beverage. Instead of creating a swirling mass of diluent, the diluent jet and concentrate dispensing outlet may be oriented substantially directly at one another such that the streams of concentrate and diluent collide causing a turbulent mixing of the diluent and the concentrate.

13 Claims, 5 Drawing Sheets

POST-MIX BEVERAGE DISPENSER FOR FROTHED BEVERAGES

BACKGROUND OF THE INVENTION

The present invention generally relates to beverage dispensers. More particularly, the present invention relates to a post-mix beverage dispenser for agitated or whipped beverages.

There are presently a number of popular beverages sold in restaurants, snack shops, amusement parks, fast food outlets, and other establishments throughout the world. Some of these beverages are served in a whipped or foamed condition. That is, the beverage is agitated or whipped in the dispensing process to give the served beverage a foamy, froth texture. Typically, these beverages are made from a combination of a concentrate and a diluent, usually water. The concentrate by itself generally does not require refrigeration and has a shelf life of several months to over a year. However, when mixed with a diluent such as water or exposed to air, the combined beverage usually requires refrigeration to retard bacterial growth.

For years, two basic type of fountain dispensers have been available to the trade, referred to respectively as "pre-mix" and "post-mix" dispensers.

Pre-mix dispensers mix a syrup concentrate and water to provide a finished beverage which is then stored in a holding tank until dispensed through a facet located on the dispenser. However, such pre-mix dispensers suffer from a number of disadvantages. Even with refrigeration, some bacterial growth is present. Consequently, after a period of time, typically a few days, any remaining pre-mix beverage should be discarded to maintain healthful quality and pleasing beverage taste. Thus, it is necessary to disassemble and clean the whipping assembly on a daily basis to remove accumulated beverage residue remaining in the whipping apparatus.

Post-mix dispensers do not pre-mix and store the syrup and water. Instead the syrup and water conveyed by separate conduits to a dispenser housing, sometimes referred to as valves or heads, and then mixed while being dispensed through the usual spout on the housing. It has been found that the majority of the mixing in such soft drink dispensers actually occurs in the beverage cup as the beverage is being dispensed as the syrup and water are merely dropped over a diffuser such that a small amount of mixing occurs in the spout, and the final mixing occurring in the beverage cup. The syrup may be stored remotely from the dispenser housing in a metallic cylinder, or in a collapsible plastic bag in a cardboard box, or any other suitable storage medium. The water source may simply be the available municipal water line. Post-mix dispensers overcome, to a great extent, the disadvantages suffered by the pre-mix dispensers. Accordingly, the majority of soft drinks and non-carbonated beverages sold in restaurants and fast-food businesses utilize post-mix dispensers.

In the early 1980's, Orange Bang, Inc. designed a dispenser for a whipped beverage comprising a specially designed plastic mixing block 1, as shown in FIG. 1. The mixing block 1 included a generally hemispherically shaped mixing chamber 2 cut-out therefrom. A syrup concentrate conduit 3 was formed in the block 1 such that it extended between the mixing chamber 2 and a solenoid valve 4 which controlled the delivery of the pressurized syrup concentrate. Similarly, a conduit 5 was formed in the block which was in fluid communication with the mixing chamber 2 and another solenoid valve 6 for controlling the amount of pressurized water which was delivered. The concentrate and water conduits 3 and 5 were angled with respect to one another such that the syrup and water would be ejected at angles which would intersect at a given point to create the frothed beverage. It was discovered that the mixing chamber 2 had to be vented to allow air to be introduced into the mixing chamber 2 and allow the concentrate and water to whip or froth. Accordingly, a vent conduit 8 was formed in the block 1. It was also found that whip-gain was improved and the possibility of the beverage entering the vent conduit 8 virtually eliminated by the addition of a metal tube 7 within the vent conduit 8 and extending into the water conduit 5. As the water cascaded over the end of the tube 7, a venturi effect was created allowing air to be drawn into the water stream, while preventing the back flow of beverage through the air vent 8 and out of the exterior of the block 1 of the dispenser. Other conduits 9 such as for electrical leads, stream control devices, etc. were formed in the mixing block 1.

U.S. Pat. No. 4,676,401 to Fox et al. discloses an improvement on this design, wherein a mixing paddle operated by a motor is introduced into the mixing chamber to improve the whip-gain of the whipped beverage.

U.S. Pat. No. 6,305,269 to Stratton, discloses a slight variation to the initial Orange Bang, Inc. beverage dispenser. To improve whip-gain, Stratton discloses the use of a uniquely configured water injection nozzle having a tube with a flattened end portion defining an elongated water injection port extending into the mixing chamber. Such specialized water injection nozzle provided sufficient whip-gain. However, the Stratton dispensing apparatus also required the specially designed plastic mixing block with the various passageways and chambers, including the air passage and for allowing air to enter the mixing chamber. Another problem with all of these devices is that, due to their specialized design, they effectively served as a stand-alone dispenser often placed next to traditional carbonated beverage dispensing banks.

Accordingly, there is a continuing need for an apparatus for preparing and dispensing whipped beverages which does not require the use of a plastic mixing block having chambers and conduits formed therein. What is further needed is such a dispenser which could be incorporated into a traditional bank of soft drink dispensers. Such a dispenser should provide optimum whip-gain such that a lower amount of syrup is required for the beverage. The present invention fulfills these needs, and provides other related advantages.

SUMMARY OF THE INVENTION

The present invention resides in a post-mix beverage dispenser for whipped or frothed beverages. The beverage dispenser does not require a specialized mixing block having conduits and chambers formed therein, such as by drilling or cutting. Instead, the dispenser preferably utilizes a conventional dispensing head modified to accomplish the present invention.

In one embodiment, a jet or outlet is in fluid communication with a source of diluent and directed at a wall of a mixing chamber at an angle such that the diluent hits the wall tangentially, forming a swirling descending mass of diluent. A concentrate dispensing outlet in fluid communication with the source of concentrate is positioned to eject concentrate into the mixing chamber. When the concentrate contacts the swirling mass of diluent, turbulent mixing of the diluent and concentrate create the frothed or whipped beverage.

Typically, the dispenser includes a head having an outlet spout attached thereto and which cooperatively define the mixing chamber. Preferably, the spout is removably attached to the head, in standard fashion, to facilitate the cleaning of the spout and the upper portion of the mixing chamber. The head includes inlet conduits fluidly connected to the sources of diluent and concentrate, and includes valves for controlling the flow of diluent and concentrate from the inlet conduits to the mixing chamber. A switch selectively operates the valves.

In a particularly preferred embodiment, a concentrate dispensing member, in fluid communication with a concentrate conduit within the head, extends into the mixing chamber and defines the concentrate dispensing outlet. Typically, the concentrate dispensing member is removably attached to the head so that it can be easily cleaned. In one form, the concentrate dispensing member includes a radially extending flange which defines the concentrate outlet, wherein the swirling mass of diluent flows over the flange causing the turbulent mixing of the diluent and the concentrate.

A diffuser is disposed within an outlet of the mixing chamber, typically in the spout below the diluent jet and concentrate outlet, such that the motion of the stream of whipped beverage is directed generally downwardly in a controlled fashion.

In another embodiment, a diluent jet or outlet is configured and positioned such so as to eject a stream of diluent therefrom and into the mixing chamber. Typically, the jet extends into the mixing chamber. A concentrate dispensing outlet, typically formed in the removable concentrate dispensing member, is oriented substantially directly at the diluent jet such that the streams of concentrate and diluent collide, causing turbulent mixing of the diluent and the concentrate to create the desired whipped beverage.

It has been found that the aforementioned arrangements allow the use of traditional dispensing heads which are modified only slightly. Furthermore, there is no need for air passageways to create venturi effects. Moreover, the whip-gain has been found to be substantially improved.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings for purposes of illustration, the present invention resides in a post-mix beverage dispenser, generally referred to by the reference number 10, which uses conventional beverage dispenser heads and components which have been modified to create a frothed beverage in accordance with the present invention.

Figure 1:
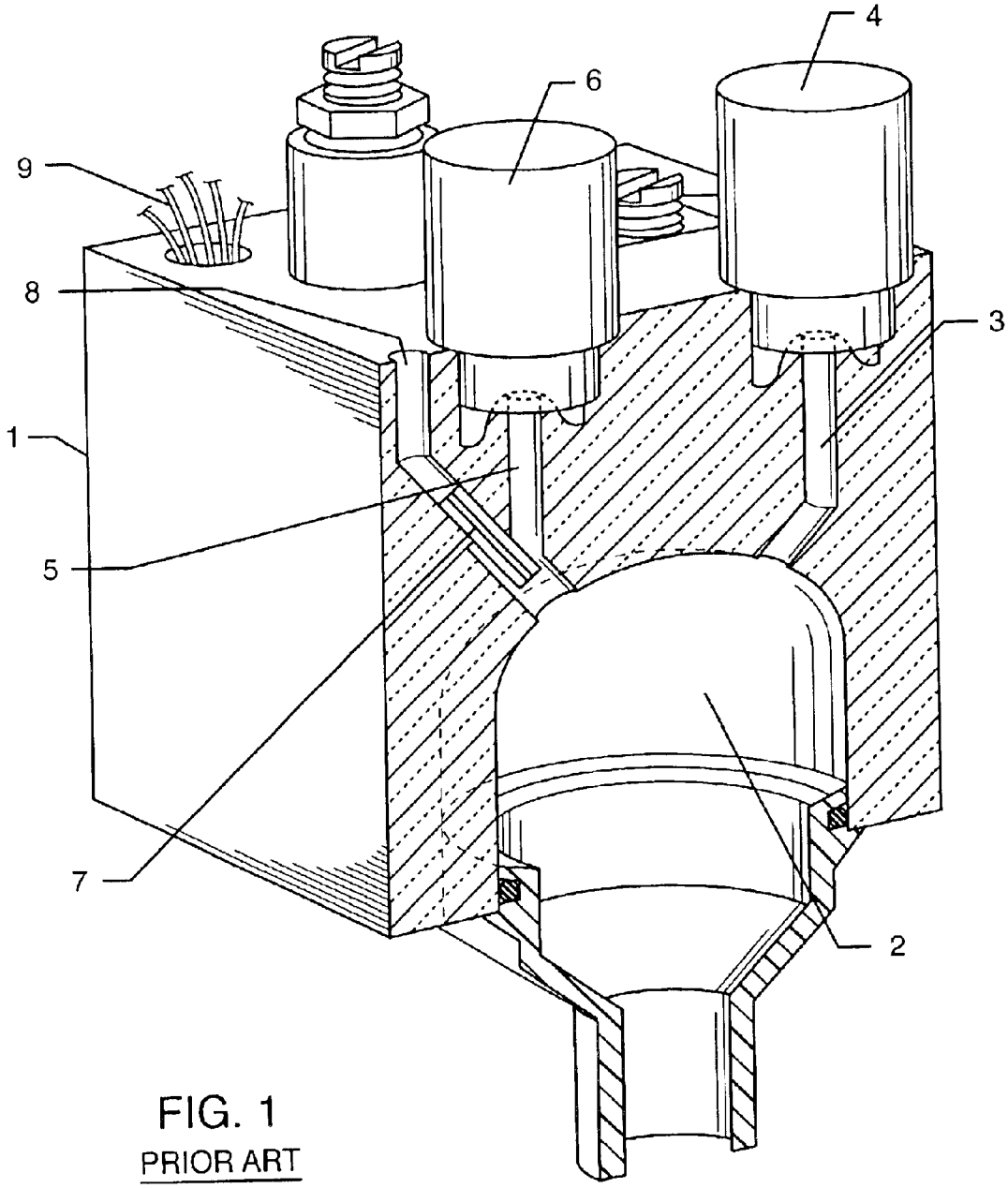
FIG. 1 PRIOR ART
FIG. 1 is a partially sectioned perspective view of a prior art mixing block and dispenser apparatus.
Figure 2:
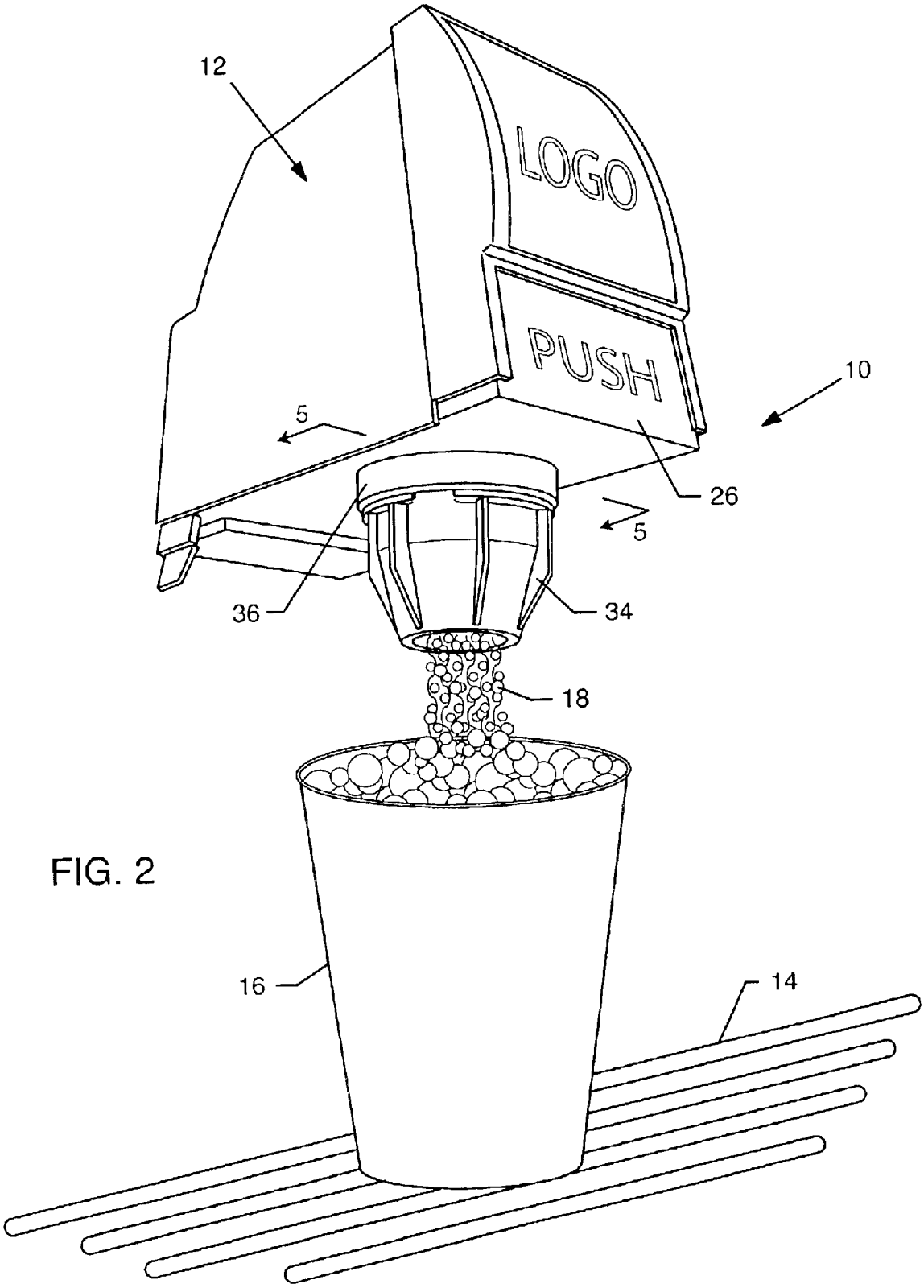
FIG. 2 is a partially fragmented perspective view of a post-mix beverage dispenser embodying the present invention delivering frothed beverage into a cup.

Referring now to FIGS. 1 and 2, a dispenser head 12 is shown which extends from a support structure (not shown) which, as is well-known in the art, can accommodate ice, fluid conduits to a source of water or other diluent, and beverage concentrates. Such support structures typically include a drain basin for collecting spilled beverage and ice, and having a grate 14 for supporting cups 16 thereon so that the cups 16 can be positioned below the dispenser head 12 to receive the frothed beverage 18.

With particular reference to FIG. 2, the dispenser head 12 includes a cover 20, shown in phantom, which houses the necessary components and conduits for dispensing a diluent, typically water, and a syrup or concentrate. As such, the head 12 includes inlet conduits 22 which are connected to fluid lines extending to either the water source or the source of concentrate. Flow regulators 24 are used to adjust the amount of water or concentrate delivered. A switch 26, such as the illustrated push-button switch, electrically activates a solenoid 28 which creates a magnetic field causing an arm 30 to move against the bias of spring 32 and open valves to allow the water and concentrate to flow into a mixing chamber. The dispenser head 12 may include other conduits and chambers for electrical lines, concentrate and diluent passageways, motors as necessary, etc. These components are traditional and well-known in the art. Dispenser heads 12 having other configurations and componentry may also be used in the present invention.

In conventional soft drink dispensers, pressurized carbonated water and syrup are dispensed through the dispenser head 12 such that the carbonated water falls substantially directly downwardly over a skirt or flange through which the syrup concentrate is emitted such that the carbonated beverage mixes as the syrup and carbonated water fall through spout 34 and into the cup 16. While performing adequately well for soft drinks, such a design does not allow the beverage to have a frothed or whipped characteristic.

With reference now to FIGS. 2–5, a generally cylindrical wall 36 extends downwardly from a bottom portion of the dispenser head 12. An inner wall 38 also extends downwardly from the head 12 generally concentric to the outer wall 36 so as to form a space or groove 40 therebetween which is configured to receive an upper circumferential edge 42 of the spout 34. The spout 34 is thus attached to the head 12 by a twist-turn frictional fit so that it is removably attached to the head 12 for cleaning purposes and the like. The spout 34 may include a protrusion 44 which is inserted bayonet-style into a mating notch and groove 40 (not shown) such that upon inserting and turning the spout 34 a quarter-turn, it is locked in place. Typically, the spout 34 is defined by generally cylindrical upper portion, which tapers at a lower portion 46 thereof to an outlet 48 through which the beverage 18 is dispensed. The generally cylindrical inner wall 38 and an inner surface of the spout 34 cooperatively form a mixing chamber for the water diluent and syrup concentrate, as will be discussed more fully herein.

A concentrate dispensing member 50 includes a upwardly extending tube 52 which is configured to be received within a concentrate conduit 54 of the head 12. A rubber O-ring 56 ensures a water-tight seal and fit between the concentrate dispensing member 50 and the concentrate conduit inner wall 54. The concentrate conduit member 50 can thus be selectively removed from the conduit 54 for cleaning purposes as the concentrate valve is opened upstream of this connection.

Figure 3:
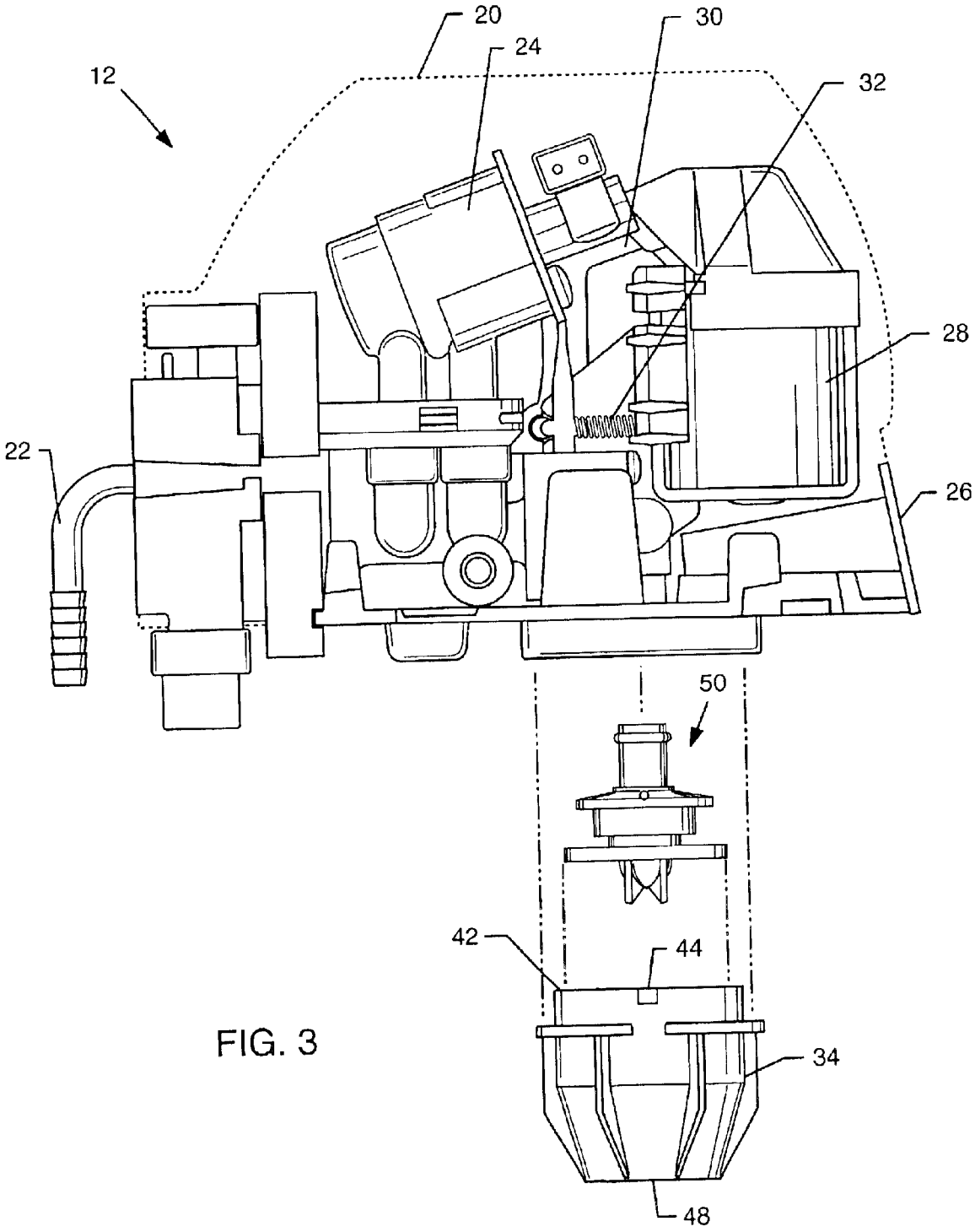
FIG. 3 is a partially exploded side perspective view of a beverage dispenser embodying the present invention, illustrating a cover thereof in phantom.
Figure 4:
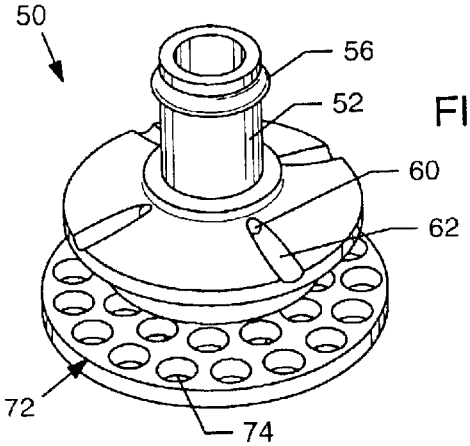
FIG. 4 is a top perspective view of a concentrate dispensing member and diffuser used in accordance with the present invention.

With particular reference to FIGS. 3 and 4, a generally circular flange or skirt 58 extends outwardly from the inlet tube 52. Outlet apertures 60 extend through the flange 58 and into the tube 52 so as to dispense pressurized concentrate therefrom. Preferably, canals or grooves 62 extend from the outlet 60 to the edge of the flange 58.

Figure 5:
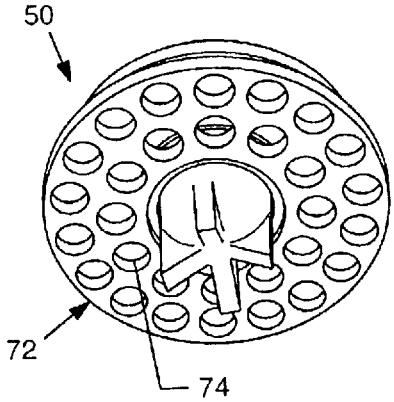
FIG. 5 is a bottom perspective view of the diffuser and concentrate dispensing member.
Figure 6:
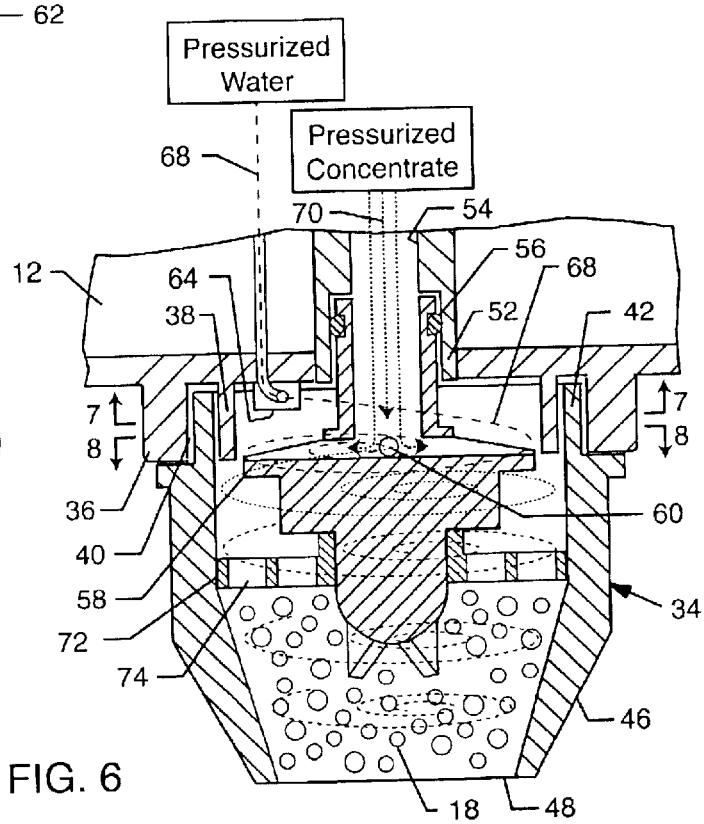
FIG. 6 is a cross-sectional view taken generally along line 5—5 of FIG. 2, illustrating the creation of a frothed beverage in accordance with a first embodiment of the present invention.

With reference now to FIGS. 5 and 6, a conduit defining diluent outlet or jet 64 extends downwardly into the mixing chamber defined by the inner wall 38 and upper portion of the spout 34. The outlet 66 is directed so as to emit a stream 68 of diluent at an angle towards the inner wall 38. The jet 64 comprises a closed-end tube having an aperture formed on a sidewall thereof. As the water diluent is pressurized, and the outlet 66 rendered of smaller cross-sectional diameter than the conduit, the fast-moving stream of diluent 68 strikes the inner wall 38 tangentially with high velocity and being contained within the circular inner wall 38 creates a swirling descending mass of diluent, similar to a vortex.

Figure 7:
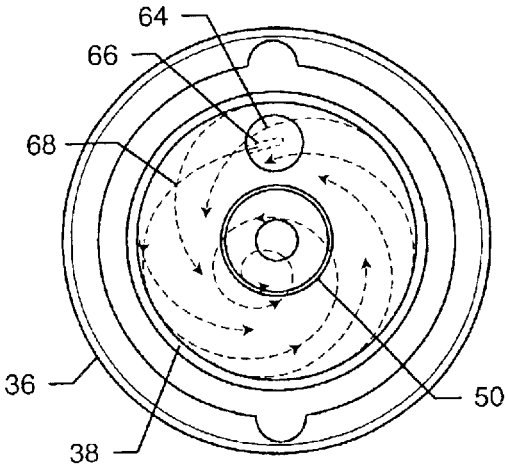
FIG. 7 is a bottom plan view taken generally along line 7—7 of FIG. 6, illustrating diluent flow in a mixing chamber of the dispenser.

As shown in FIGS. 5 and 7, the swirling stream of water diluent 68 flows over the flange 58 of the concentrate dispensing member 50 such that as the pressurized concentrate 70 is emitted through outlet apertures 60, the diluent stream 68 contacts the concentrate 70 causing a turbulent mixing of the diluent 68 and concentrate 70. This turbulent mixing, caused by the high velocity of the circularly swirling diluent 68 and pressurized concentrate 70, absorbs air entering through the opening of the spout 34 such that a frothed beverage is formed having a relatively high whip-gain.

With reference to FIGS. 3–5, the swirling mixture of diluent 68 and concentrate 70 flows over the flange 58 and onto a diffuser 72, which is typically formed with, or otherwise attached to, a lower end of the concentrate dispensing member 50. However, the diffuser 72 can be positioned anywhere between the outlets 60 and 66 of the water and concentrate and the outlet 48 of the spout 34. The diffuser comprises a disk having multiple apertures 74 formed therethrough such that the beverage 18 which has been mixed and frothed is converted from a swirling state to a more linear state such that it is directed through the outlet 48 of spout 34 and into the cup 16 in a fairly controlled manner. The use of a diffuser is optional, but it has been found that it helps in controlling the flow of the whipped beverage into the cup. However, the diffuser must permit air to enter through the opening of the spout and into the mixing chamber such that the frothed beverage is created while not requiring a vent tube.

It has been found that the process of mixing the water diluent 68 and concentrate 70 as described above eliminates the need for venting tubes, improves whip-gain of the beverage 18 and enables the use of more traditional and conventional dispenser heads 12 while mixing the beverage within the mixing chamber before it is dispensed into the beverage cup. Similar to traditional dispenser heads 12, to clean the dispenser 10, one merely need remove the spout 34 and concentrate dispensing member 50, which can be washed separately, and wipe the bottom portion of the head with a wash cloth in a traditional manner.

Figure 8:
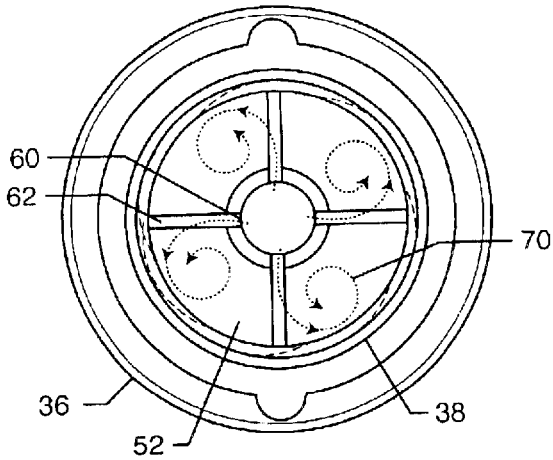
FIG. 8 is a top plan view taken generally along line 8—8 of FIG. 6, illustrating the flow of concentrate coming into contact with the diluent flow.
Figure 9:
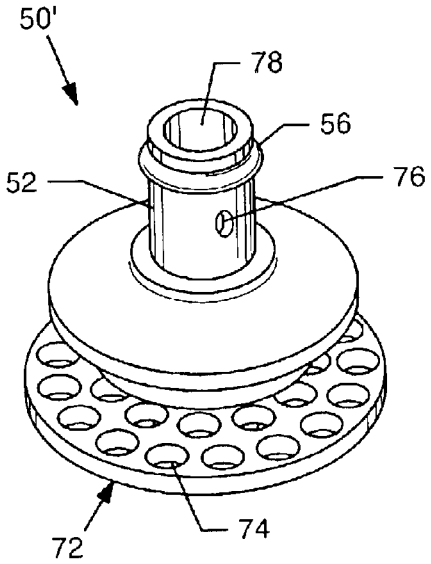
FIG. 9 is a side perspective view of a concentrate dispensing member and diffuser used in accordance with a second embodiment of the present invention.
Figure 10:
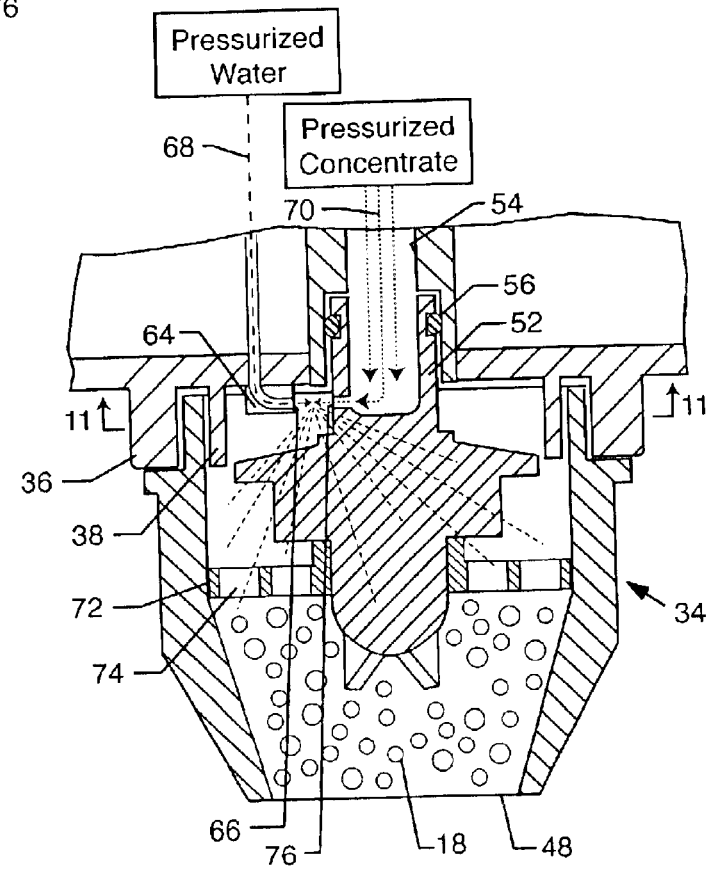
FIG. 10 is a partially fragmented and cross-sectional view of a beverage dispenser used in accordance with the second embodiment of the present invention.
Figure 11:
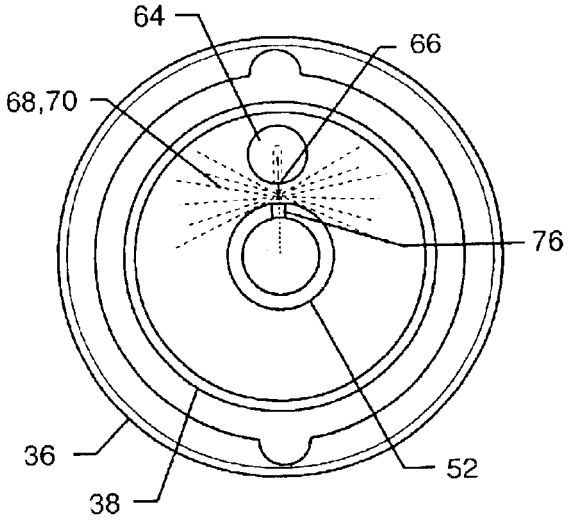
FIG. 11 is a bottom plan view taken generally along line 11—11 of FIG. 10, illustrating opposed diluent and concentrate outlets directing streams towards one another to create the frothed beverage.

With references now to FIGS. 8–10, another embodiment of the present invention is illustrated. It has been found that the aforementioned benefits can also be produced by directing high velocity, pressurized streams of concentrate 70 and water 68 directly at one another. With reference to FIG. 8, a single concentrate outlet 76 is formed in the tube 52 of the concentrate dispensing member 50'. Preferably, the outlet 76 is of a reduced cross-sectional diameter as compared to the cross-sectional diameter of the inlet of the tube 52. Thus, the pressurized concentrate 70 is accelerated even further through the outlet 76 so as to attain a high speed.

As shown in FIGS. 9 and 10, the water outlet 66 of the jet 64 extending into the mixing chamber is directed substantially opposite the outlet 76 of the concentrate dispensing member 50' such that the pressurized and high velocity streams of water 68 and concentrate 70 collide with tremendous force and cause turbulent mixing of the diluent 68 and concentrate 70 with the incorporation of small air bubbles which cause the beverage to have a frothed or whipped characteristic. The frothed beverage 18 is then directed by gravity through diffuser 72 and out the spout 34 through outlet 48 and into the serving cup 16.

Although several embodiments have been described in detail for purposes of illustration, various modifications may be made without departing from the scope and spirit of the invention. Accordingly, the invention is not to be limited, except as by the appended claims.

What is claimed is:

1. A post-mix beverage dispenser for frothed beverages, comprising:

a mixing chamber;

a jet in fluid communication with a source of diluent and directed at a wall of the mixing chamber such that a swirling descending mass of diluent is formed;

a concentrate dispensing outlet in fluid communication with a source of concentrate and positioned to eject concentrate into the mixing chamber, wherein concentrate ejected from the concentrate outlet contacts the swirling mass of diluent causing turbulent mixing of the diluent and the concentrate to create a frothed beverage;

wherein the diluent jet is directed at the wall such that the diluent hits the wall tangentially;

wherein the concentrate dispensing member includes a radially extending flange defining the concentrate outlet; and wherein the swirling mass of diluent flows over the flange, causing turbulent mixing of the diluent and the concentrate.

2. The dispenser of claim 1, including a concentrate dispensing member defining the concentrate dispensing outlet and extending into the mixing chamber.

3. The dispenser of claim 2, wherein the mixing chamber is defined by an outlet spout attached to a dispensing head.

4. The dispenser of claim 3, wherein the spout is removably attached to the head.

5. The dispenser of claim 3, wherein the concentrate dispensing member is removably attached to a concentrate conduit of the head.

6. The dispenser of claim 1, including a diffuser disposed within an outlet of the mixing chamber.

7. The dispenser of claim 2, wherein the head includes inlet conduits fluidly connected to the sources of diluent and concentrate, and valves for controlling the flow of diluent and concentrate from the inlet conduits to the mixing chamber.

8. The dispenser of claim 7, including a switch for operating the valves.

9. A post-mix beverage dispenser for frothed beverages, comprising:

a head including inlet conduits fluidly connected to sources of diluent and concentrate, and valves for controlling the flow of pressurized diluent and concentrate;

a switch for operating the valves;

an outlet spout extending from the head, the spout and the head cooperatively defining a mixing chamber;

a jet in fluid communication with the source of diluent and directed at a wall of the mixing chamber such that the diluent hits the wall tangentially forming a swirling descending mass of diluent; and a concentrate dispensing member extending into the mixing chamber and in fluid communication with the source of concentrate, the dispensing member having a concentrate outlet disposed downstream of the diluent jet, wherein the swirling descending mass of diluent flows over the concentrate outlet causing turbulent mixing of the diluent and the concentrate to create a frothed beverage.

10. The dispenser of claim 9, wherein the spout is removably attached to the head.

11. The dispenser of claim 9, wherein the concentrate dispensing member is removably attached to a concentrate conduit of the head.

12. The dispenser of claim 9, wherein the concentrate dispensing member includes a radially extending flange defining the concentrate outlet.

13. The dispenser of claim 9, including a diffuser disposed within the outlet spout and below the concentrate outlet of the concentrate dispensing member.

* * * * *